US007146960B2

(12) United States Patent
Phlips et al.

(10) Patent No.: US 7,146,960 B2
(45) Date of Patent: Dec. 12, 2006

(54) ENGINE SHUT DOWN USING FLUID PUMP TO CONTROL CRANKSHAFT STOPPING POSITION

(75) Inventors: Patrick Phlips, Cologne (DE); Bernd Steiner, Bergisch (DE); Klemens Greiser, Langenfeld (DE); Ulrich Kramer, Berglsch-Gladbach (DE); Markus Lemmen, Krefeld (DE); Ulla Weimann Macdonald, Romford (GB)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/164,017

(22) Filed: Nov. 7, 2005

(65) Prior Publication Data

US 2006/0102137 A1 May 18, 2006

(30) Foreign Application Priority Data

Nov. 16, 2004 (EP) ..... 04105806
Nov. 17, 2004 (EP) ..... 04105838

(51) Int. Cl.
*F02D 41/00* (2006.01)
*F02B 67/04* (2006.01)

(52) U.S. Cl. ..... 123/179.4; 123/198 C

(58) Field of Classification Search ..... 123/179.4; 701/112; 123/198 C
See application file for complete search history.

(56) References Cited

U.S. PATENT DOCUMENTS 4,406,951 A 9/1983 Inoue et al.
5,456,233 A 10/1995 Felhofer
5,636,611 A 6/1997 Frankle et al.
6,834,632 B1 * 12/2004 Kataoka et al. ..... 123/179.4
7,066,128 B1 * 6/2006 Satake et al. ..... 123/179.4
2001/0018903 A1 9/2001 Hirose et al.
2002/0078928 A1 6/2002 Onishi et al.
2003/0204302 A1 10/2003 Naoki
2004/0123831 A1 7/2004 Grieser et al.
2004/0144342 A1 7/2004 Sieber et al.
2004/0149245 A1 8/2004 Moriya
2004/0231619 A1 11/2004 Hirano

FOREIGN PATENT DOCUMENTS

DE 4313852 A1 11/1994
DE 10144895 A1 10/2002
DE 10123037 A1 11/2004
EP 1132245 A 9/2001
EP 1396622 A 3/2004

OTHER PUBLICATIONS

EPO Search Report, App. No. 04105806.6, Apr. 29, 2005.
EPO Search Report, App. No. 04105838.9, May 20, 2005.
U.S. Appl. No. 11/164,047; "System and Method For Controlling Crankshaft Position During Engine Shutdown Using Cylinder Pressure"; Filed Nov. 8, 2005.
U.S. Appl. No. 11/163,975; "Systems and Methods for Controlled Shutdown and Direct Start for Internal Combustion Engine"; Filed Nov. 4, 2005.

* cited by examiner

*Primary Examiner*—Stephen K. Cronin
*Assistant Examiner*—Arnold Castro
(74) *Attorney, Agent, or Firm*—Donald J. Lewis; Bir Law, PLC

(57) ABSTRACT

Systems and methods for controlling stopping position of a crankshaft during shutdown of an internal combustion engine control a fluid pressure to control a corresponding drive torque of a fluid pump. Kinetic energy of the engine at shutdown may be used to control fluid pressure in a power steering system or fuel injection system to stop the crankshaft in a position favorable for restarting.

20 Claims, 6 Drawing Sheets

ENGINE SHUT DOWN USING FLUID PUMP TO CONTROL CRANKSHAFT STOPPING POSITION

CROSS REFERENCE TO RELATED APPLICATIONS

This application claims priority under 35 USC §119 to European Patent Application Nos. 04105806.6, filed Nov. 16, 2004 and 04105838.9 filed Nov. 17, 2004.

BACKGROUND OF THE INVENTION

1. Field of the Invention

The present invention relates to systems and methods for controlled shutdown and direct starting of an internal combustion engine.

2. Background Art

One concept for improving fuel consumption of a vehicle is to shut down the internal combustion engine if there is no requirement for power instead of allowing it to continue to idle. One application is stop and go traffic that may occur in traffic jams on freeways as well as at traffic lights, railroad crossings, etc.

One problem with the concepts that shut down the internal combustion engine when it is not required to improve fuel consumption is the necessity to restart the internal combustion engine. When the internal combustion engine is shut down in an uncontrolled way, the crankshaft and the camshaft stop in an unknown random position. Consequently, the position of the pistons in the individual cylinders is also unknown. Accurate crankshaft position information is, however, useful for restarting the engine in an uncomplicated manner that is as fast and efficient as possible and thus saves fuel. For example, in engines with direct injection, it is possible to start or restart the engine directly from the stationary state without a starter motor by injecting fuel directly into the combustion chambers and igniting the fuel/air mixture using a spark plug. To be carried out successfully, it is advantageous if the crankshaft is at or near a specific position at the commencement of the starting so that at least one piston is in a position where a fuel injection and subsequent ignition of the air/fuel mixture lead to movement of the piston within the cylinder. In a four-stroke internal combustion engine, the piston would have to be in the expansion or working stroke with at least one associated exhaust valve closed. As such, this method for direct starting or restarting requires an accurate indication of the crankshaft position or piston position to select appropriate cylinders for the fuel injection to start the engine.

In an internal combustion engine equipped with an electronically regulated ignition and/or an electronically regulated injection, crankshaft or camshaft sensors may be used to control the ignition and injection timing. However, these sensors require rotation of the crankshaft to provide a signal and provide ambiguous information for a number of cylinder firings immediately after starting or restarting the engine so that some time is required to synchronize the crank angle position and the engine control parameters. In addition, devices have to be provided for starting or restarting the internal combustion engine, such as a conventional starter motor, electric motor, or a similar device suitable for rotating the crankshaft.

Various concepts have been proposed in the prior art for controlling the stopping position of the crankshaft (or adjusting the position after the engine is stopped) and for restarting the engine. These concepts may generally be categorized as either active or passive. The active adjustment devices either require additional components, such as an additional electric motor, to apply an adjustment torque, or operate using an additional fuel injection or ignition in the same way as when selective combustion processes are initiated in order to set the predefined crank angle position. Concepts that employ active devices that require additional fuel or electrical energy are contrary to the basic goal of shutting down the engine to save fuel or energy to improve fuel economy.

Passive adjustment devices may use the rotational movement of the crankshaft during shut down after fuel and/or ignition have ended to control the stopping position of the crankshaft in a predefined advantageous position. For example, an intake/exhaust (gas exchange) valve control system may be used as a passive adjustment device to exert a stopping or braking force on the engine or crankshaft to control deceleration and stopping position. However, many of the disclosed concepts are not suitable for controlling the stopping position of the crankshaft with the necessary accuracy to facilitate direct restart.

SUMMARY OF THE INVENTION

A system and method for controlling stopping position of a crankshaft during shutdown of an internal combustion engine include influencing fluid pressure to influence drive torque of a corresponding fluid pump driven by the crankshaft so that the crankshaft stops in a position favorable for restarting.

In one embodiment of the present invention a power steering system includes a controllable variable flow device to change pressure within the power steering system to increase or decrease the corresponding drive torque of the power steering pump during shutdown. Another embodiment of the invention includes a fuel distribution system with a controllable variable flow device to change pressure within the fuel distribution system to increase or decrease the corresponding drive torque of the fuel pump. The controllable variable flow device may include a valve and/or a variable throughput pump.

The present invention provides a number of advantages. For example, the present invention controls one or more engine fluid pumps that are already included on conventional engines to carry out a controlled shutdown so that additional adjustment devices are unnecessary. The present invention uses passive adjustment rather than active adjustment to place the crankshaft in a favorable position for restarting. The fluid pump acts as a passive adjustment device that exerts a torque on the crankshaft until the crankshaft comes to a standstill in a desired position. Use of a passive adjustment device provides the advantage that its energy consumption is lower because it does not initiate a rotational movement of the crankshaft but instead controls deceleration of the existing rotational movement of the crankshaft and is therefore energy and fuel efficient.

The above advantages and other advantages and features of the present invention will be readily apparent from the following detailed description of the preferred embodiments when taken in connection with the accompanying drawings.

DETAILED DESCRIPTION OF THE PREFERRED EMBODIMENT(S)

Figure 1:
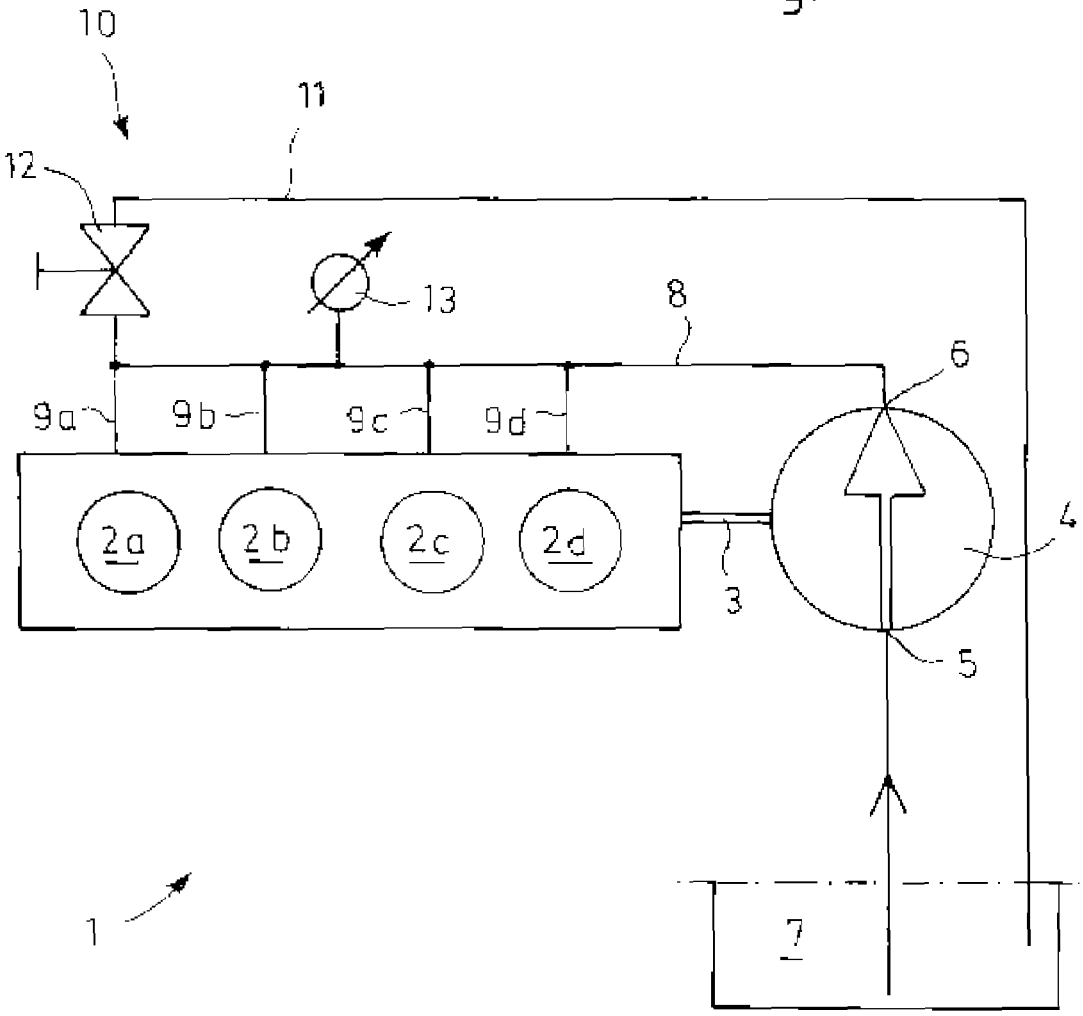
FIG. 1 is a schematic view of a first embodiment of an internal combustion engine using fluid pressure to control crankshaft stopping position according to the present invention.

Throughout the description of the preferred embodiments of the present invention, the same reference numerals have been used for components having the same or substantially similar function as a previously described component such that the description is not unnecessarily repeated.

As those of ordinary skill in the art will understand, various features of the present invention as illustrated and described with reference to any one of the embodiments or Figures may be combined with features illustrated in one or more other embodiments or Figures to produce embodiments of the present invention that are not explicitly illustrated or described. The combinations of features illustrated provide representative embodiments for typical applications. However, various combinations and modifications of the features consistent with the teachings of the present invention may be desired for particular applications or implementations.

FIG. 1 is a schematic view of a first embodiment of an internal combustion engine 1. A method for the controlled shutting down of the internal combustion engine 1 will be described in more detail in conjunction with the explanation of the internal combustion engine 1.

The internal combustion engine 1 has four (n=4) cylinders 2*a*, 2*b*, 2*c*, 2*d* and a fuel pump 4 driven by crankshaft 3. Fuel pump 4 is supplied with fuel via inlet 5 from a fuel tank container 7. The fuel is fed by fuel pump 4 from the inlet 5 to the outlet opening 6 into a composite fuel line 8 which adjoins the outlet.

Four (n=4) fuel lines 9*a*, 9*b*, 9*c*, 9*d* branch off composite fuel line 8 with each leading to one of the four cylinders 2*a*, 2*b*, 2*c*, 2*d* to supply the cylinders with fuel.

To influence the drive torque of fuel pump 4, a fuel return line 11 with a shut-off element 12 is provided and coupled to composite fuel line 8 downstream of fuel lines 9*a*, 9*b*, 9*c*, 9*d*. Fuel return line 11 and shut-off element 12 serve to influence the pressure in the fuel lines 8, 9*a*, 9*b*, 9*c*, 9*d* and thus serve as means 10 for controlling the necessary drive torque of the fuel pump 4. A valve is used as a shut-off element 12.

After internal combustion engine 1 has been shut down, i.e. after the spark ignition and fuel injectors associated with cylinders 2*a*, 2*b*, 2*c*, and 2*d* have been stopped, fuel pump 4 continues to feed fuel into the fuel lines 8, 9*a*, 9*b*, 9*c*, 9*d* as crankshaft 3 coasts to a stop, even though fuel is no longer required to keep the internal combustion engine 1 operating. As such, the pressure in fuel lines 8, 9*a*, 9*b*, 9*c*, 9*d* continues to be maintained or increases. As a result, fuel pump 4 feeds against a rising fuel pressure, which leads to an increase in the necessary drive torque of fuel pump 4.

A fuel return line 11 is provided to influence the fuel pressure in fuel lines 8, 9*a*, 9*b*, 9*c*, 9*d* and the resulting necessary drive torque of fuel pump 4 be returning fuel from fuel lines 8, 9*a*, 9*b*, 9*c*, 9*d* to fuel tank container 7 to form an enclosed fuel circuit. The quantity of fuel removed or recirculated is controlled by valve 12 arranged in fuel return line 11, which influences pressure in fuel lines 8, 9*a*, 9*b*, 9*c*, 9*d*. Because the drive torque necessary to drive fuel pump 4 depends on this pressure, the drive torque of fuel pump 4 is also influenced by opening and closing valve 12. Closing valve 12 leads to an increased fuel pressure and a corresponding larger drive torque becomes necessary. Conversely, opening of valve 12 leads to a lower pressure in fuel lines 8, 9*a*, 9*b*, 9*c*, 9*d* so that the necessary drive torque to operate fuel pump 4 decreases. By decreasing or increasing the flow cross section of the shut-off element 12 and thus the flow resistance which is changed in this way it is possible to increase or decrease the pressure in the corresponding fuel lines.

A first pressure sensor 13 senses the instantaneous pressure in fuel lines 8, 9*a*, 9*b*, 9*c*, 9*d* and communicates with an engine control system (not illustrated) that actuates valve 12 arranged in fuel return line 11. According to the inventive method, valve 12 is controlled in such a way that the energy emitted by internal combustion engine 1 until it comes to a standstill after the ignition and/or the fuel supply has been switched off is consumed by means of the drive torque of fuel pump 4 in a controlled fashion such that the internal combustion engine 1, i.e. crankshaft 3, is stopped in a position favorable for restarting.

In order to be able to set a specific preferred position of the crankshaft precisely, a plurality of information items is in fact necessary and/or helpful. In this context, it is helpful to have recourse to all the data which has already been measured for the customary engine control and/or data which has been derived, in particular to the engine speed, the crankshaft angle, the temperature of the engine and/or a temperature which is correlated thereto such as the coolant temperature and/or the intake pressure in the intake manifold. The aforesaid variables have according to the invention the largest influence on the coasting movement of the internal combustion engine and/or of the crankshaft.

To determine and control stopping position of the crankshaft it may be necessary and/or helpful to determine how much kinetic energy is present in the drive train and/or in the crankshaft after the internal combustion engine has been shut down. A model of the coasting movement of an internal combustion engine is described, for example, in the European patent application No. 03101379.0. This model takes into account the current kinetic energy of the drive train, the friction losses and/or the compression and expansion processes in the cylinders of the internal combustion engine. Such a model can be acquired on the basis of theoretical considerations and implemented in the form of mathematical equations. However, the model is preferably acquired entirely or at least partially empirically, i.e. by observing the engine behavior and conditioning of the measured data acquired in the process (for example as a lookup table).

Figure 2:
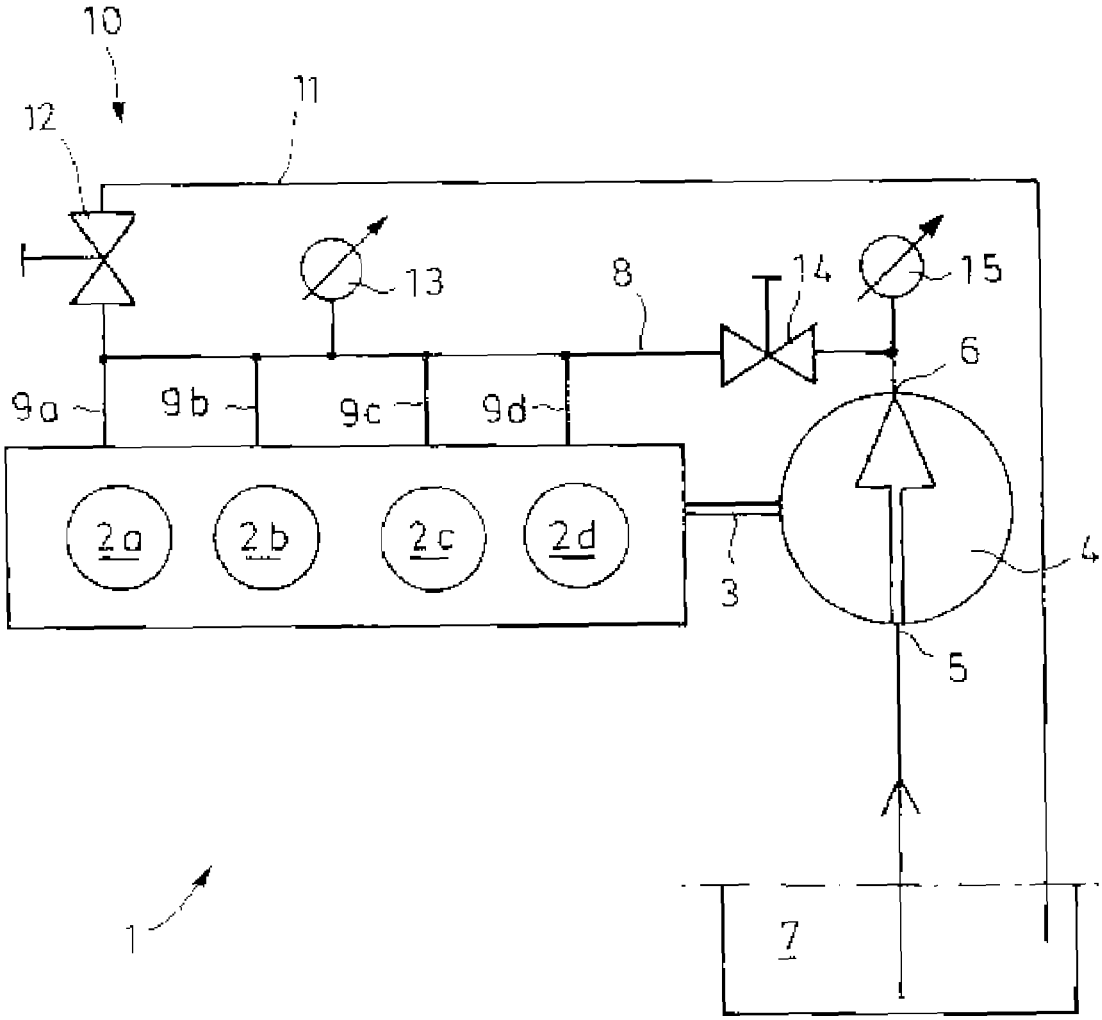
FIG. 2 is a schematic view of a second embodiment of an internal combustion engine according to the present invention.

FIG. 2 is a schematic view of a second embodiment of the internal combustion engine 1. The same reference symbols have been used for the same components so that the description is not repeated.

In contrast to the embodiment of FIG. 1, internal combustion engine 1 has a second shut-off element 14 arranged upstream of the four branching fuel lines 9*a*, 9*b*, 9*c*, 9*d*. Second shut-off element 14 permits influencing the fuel pressure and therefore the drive torque of fuel pump 4 without affecting the pressure of fuel in fuel lines 9*a*, 9*b*, 9*c*, 9*d*. A second pressure sensor 15 is arranged upstream of the second valve 14 in the composite fuel line 8. Pressure which is relevant to control the drive torque of fuel pump 4 at outlet 6 is changed using second valve 14 with the pressure in fuel lines 9*a*, 9*b*, 9*c*, 9*d* remaining uninfluenced at the same time, in particular irrespective of the control of the fuel pump 4 and the change in the pressure in composite fuel line 8 between outlet 6 and second valve 14. By varying the drive torque of fuel pump 4, the load which is tapped from crankshaft 3 is varied. The rotational movement of crankshaft 3 as crankshaft 3 runs on after internal combustion engine 1 has been switched off, is influenced by controlling the drive torque of fuel pump 4 in such a way that crankshaft 3 comes to a standstill in a predefined, advantageous crankshaft position.

Figure 3:
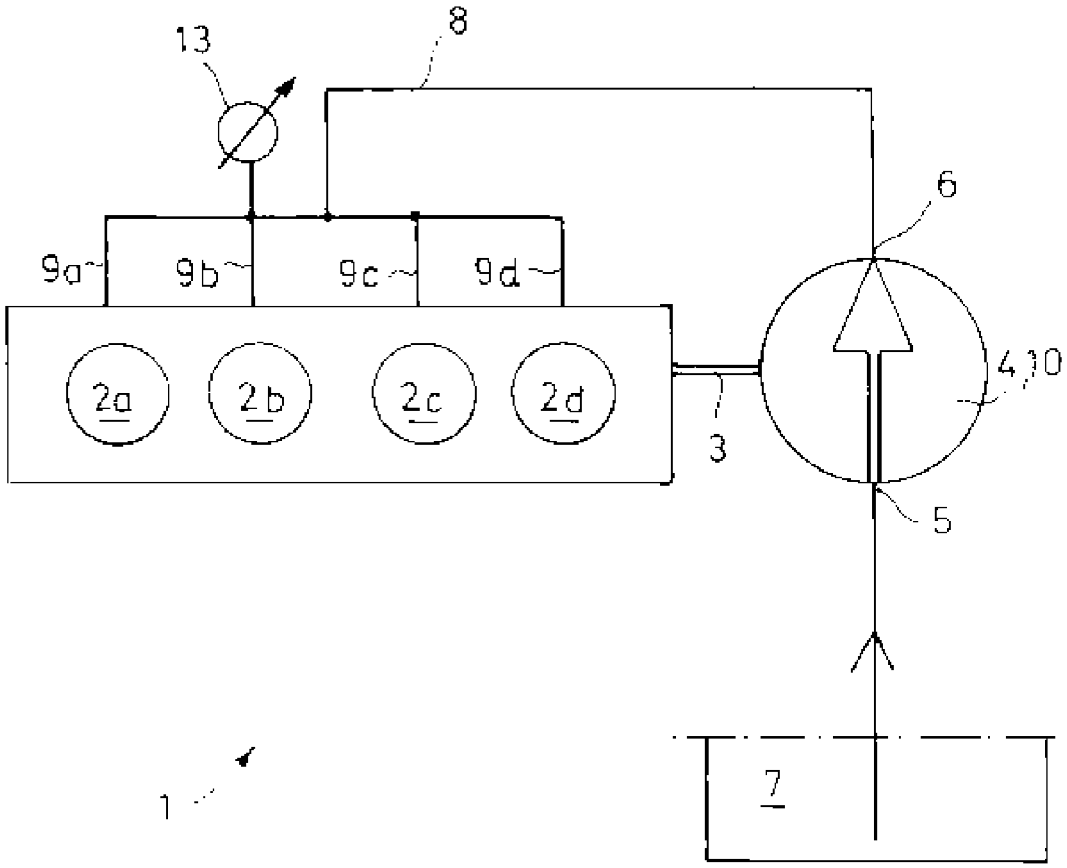
FIG. 3 is a schematic view of a third embodiment of an internal combustion engine according to the present invention.

FIG. 3 is a schematic view of a third embodiment of internal combustion engine 1. Only the differences with respect to the first embodiment illustrated in FIG. 1 will be described with the same reference numerals being used for the same components.

Internal combustion engine 1 shown in FIG. 3 has a fuel pump 4 whose feed characteristic or throughput rate can be changed so that the drive torque can be varied without the internal combustion engine 1 having to be equipped with a shut-off element or fuel return line. For example, the use of an adjustable axial piston pump having a variable piston stroke may be used to provide a variable feed characteristic or a variable throughput rate. In the embodiment illustrated in FIG. 3, fuel pump 4 acts as the means 10 for influencing the drive torque of the fuel pump and at the same time a means for influencing the pressure in fuel lines 8, 9*a*, 9*b*, 9*c*, 9*d*.

If the throughput rate of fuel pump 4 is increased, pump 4 feeds large quantities of fuel into the fuel lines 8, 9*a*, 9*b*, 9*c*, 9*d*, with the pressure in the fuel lines 8, 9*a*, 9*b*, 9*c*, 9*d* rising owing to the lack of consumption of fuel. Fuel pump 4 must then pump against an increased pressure at outlet 6, which requires an increased drive torque. Conversely, the necessary drive torque can be decreased by reducing the throughput rate.

Alternatively, fuel pump 4 may have a variable outlet 6 with which the flow resistance of outlet 6 can be varied as means for influencing its drive torque. By decreasing or increasing the cross-section of outlet 6, the flow resistance is changed such that the pressure in fuel pump 4 is decreased or increased, respectively, to vary the drive torque of fuel pump 4. Adjustment in the direction of closing and thus a decrease in the outlet cross section of outlet 6 leads to an increased pressure in fuel pump 4 and an increased drive torque. Conversely, adjustment in the direction of opening and thus an increase in the outlet cross section of outlet 6 leads to a lower pressure in fuel pump 4 and a decreased drive torque.

Figure 4:
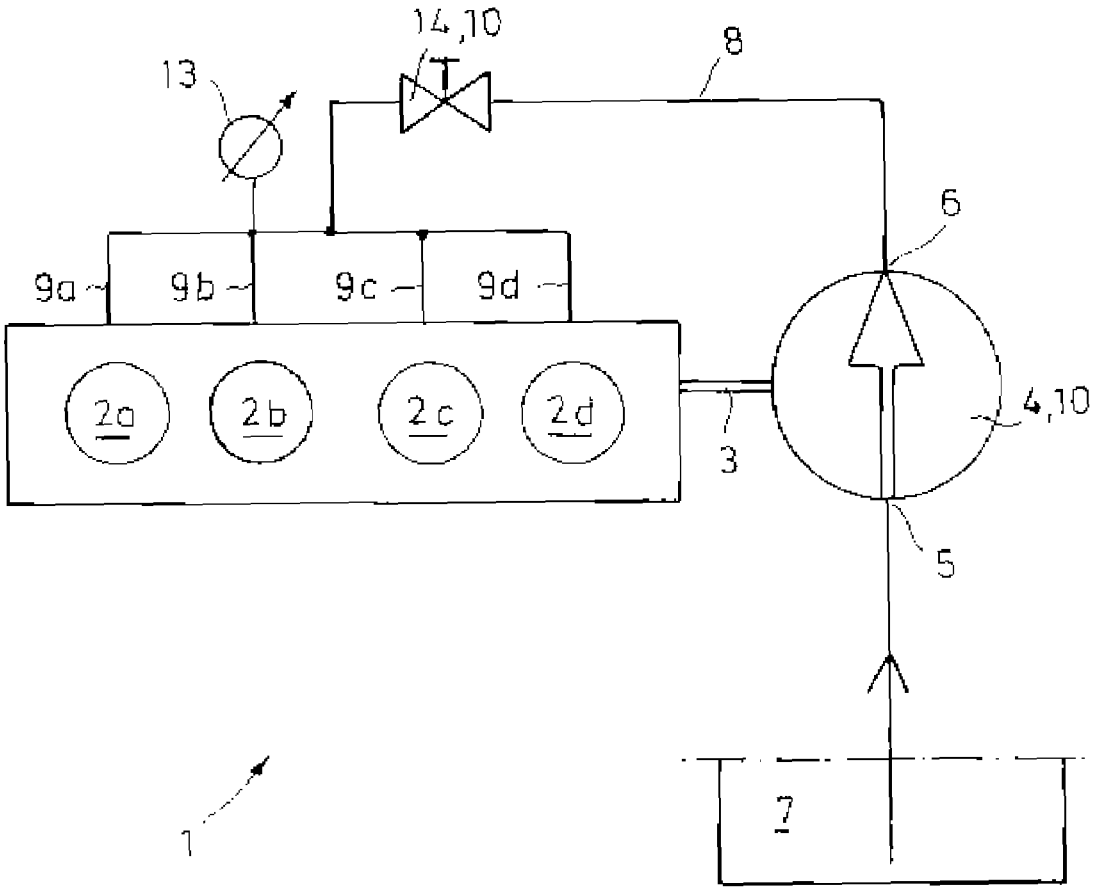
FIG. 4 is a schematic view of a fourth embodiment of an internal combustion engine according to the present invention.

FIG. 4 is a schematic view of a fourth embodiment of internal combustion engine 1. Internal combustion engine 1 shown in FIG. 4 has a second shut-off element 14 arranged upstream of fuel lines 9*a*, 9*b*, 9*c*, 9*d* in composite fuel line 8. Second shut-off element 14, as explained with respect to FIG. 2, allows the pressure which is decisive for the drive torque of the fuel pump 4 to be influenced without the pressure in fuel lines 9*a*, 9*b*, 9*c*, 9*d* being adversely influenced. The pressure relevant for controlling the drive torque of fuel pump 4, at outlet 6 of fuel pump 4, is changed using second valve 14, with the pressure of fuel lines 9*a*, 9*b*, 9*c*, 9*d* remaining uninfluenced at the same time, in particular irrespective of the control of the fuel pump 4 and the change in the pressure in the part of composite fuel line 8 lying between outlet 6 and second valve 14.

As a result, the embodiment illustrated in FIG. 4 has two different means 10 for influencing the drive torque of fuel pump 4, specifically second valve 14 and fuel pump 4, which has an adjustable throughput rate.

Figure 5:
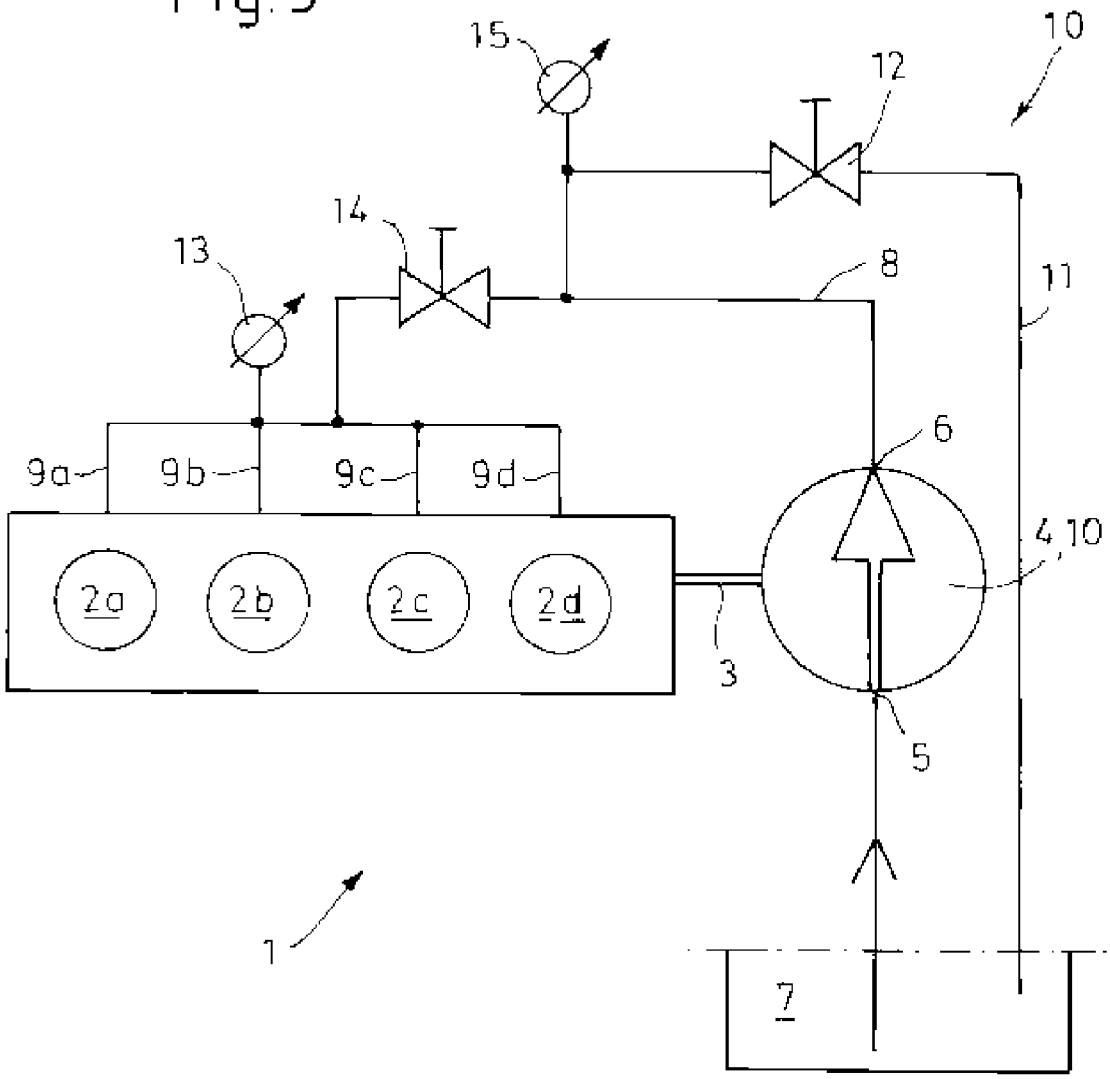
FIG. 5 is a schematic view of a fifth embodiment of an internal combustion engine according to the present invention.

FIG. 5 is a schematic view of a fifth embodiment of the present invention with internal combustion engine 1 having a fuel return line 11 branching off from composite fuel line 8 upstream of second valve 14 and leading to fuel tank container 7. A first shut-off element 12 arranged in fuel return line 11 controls the quantity of recirculated fuel. A second pressure sensor 15 arranged upstream of second shut-off element 12 is also provided in fuel return line 11. Fuel return line 11 and shut-off element 12 are used to influence the pressure in fuel lines 8, 9*a*, 9*b*, 9*c*, 9*d* and thus as means 10 for controlling the drive torque of fuel pump 4. This embodiment permits a maximum degree of flexibility and accuracy in positioning crankshaft 3 during the controlled shutting down of internal combustion engine 1 in that second valve 14 can be used in combination with variable throughput fuel pump 4 to influence the necessary drive torque and resulting energy consumed from crankshaft 3.

As such, in order to influence the drive torque of the fuel pump, means are provided with which the power tapped from the crankshaft by the fuel pump can be varied. In other words, the fuel pump, which is considered an energy consumer, is operated in such a way that the consumption of energy as the crankshaft coasts after fuel and ignition are switched off has a profile that results in the crankshaft stopping in a desired position with the necessary accuracy favorable for restarting the engine, whether using direct starting or a conventional starter motor.

Figure 6:
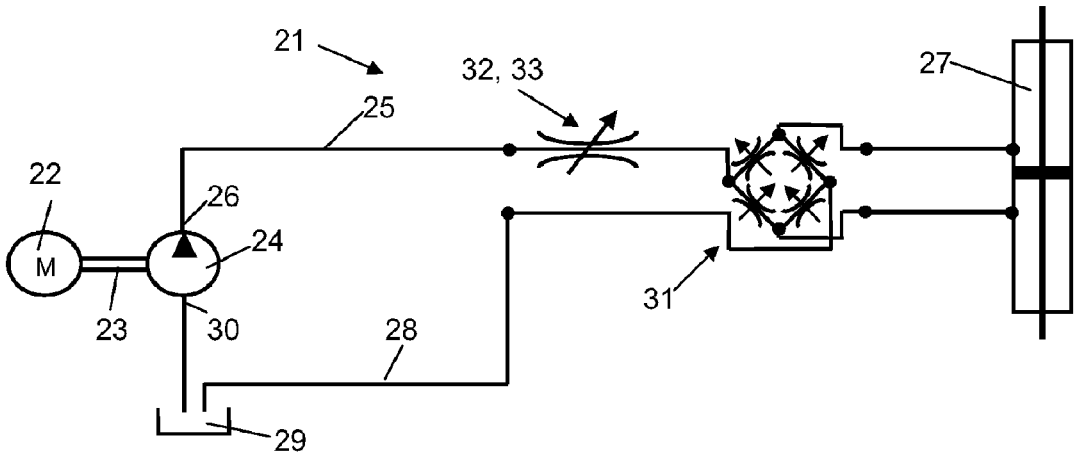
FIG. 6 is a schematic view of a sixth embodiment of an internal combustion engine according to the present invention.

FIG. 6 is a schematic view of another embodiment of the present invention that includes controlling a hydraulic pump 24 associated with a power steering system 21 to control stopping position of crankshaft 23 during engine shutdown. In this embodiment, internal combustion engine 22 is equipped with a hydraulic power steering system 21 to provide an auxiliary force for servo-assisted steering. Power assisted steering system 21 includes a hydraulic fluid pump 24 driven by internal combustion engine 22 by crankshaft 23, which can be carried out, for example, by means of a V belt (not shown).

Hydraulic pump 24 supplies pressurized oil to a working cylinder 27, such as a toothed rack hydraulic steering system, via supply line 25. Supply line 25 adjoins outlet 26 of hydraulic pump 24. Oil return line 28 returns oil into a tank container 29 which in turn feeds the hydraulic pump 24 via inlet 30. A rotary slide valve 31 is arranged between hydraulic pump 24 and working cylinder 27.

To shut down internal combustion engine 22 in a controlled fashion according to the present invention, i.e. to bring crankshaft 23 to a standstill in a position favorable for restarting, the drive torque of hydraulic pump 24 is controlled so that the energy of internal combustion engine 22 is consumed by the drive torque of hydraulic pump 4 in a controlled fashion. As previously described, kinetic energy of the engine may be determined using a analytic or empirical model and used in controlling the stopping position of crankshaft 23.

In the embodiment illustrated in FIG. 6, a shut-off element 32 is arranged in supply line 25 to influence the drive torque of the hydraulic pump 24 be influencing the pressure in line 25 in a manner described previously with respect to FIGS. 1–5. After fuel to the cylinders has been shut off, the rotational movement of crankshaft 23 continues to drive hydraulic pump 24, which continues to feed pressurized oil into supply line 25. Shut-off element 32 is controlled to provide a pressure in line 25 which affects drive torque of hydraulic pump 24. If the pressure in supply line 25 increases, hydraulic pump 24 must pump against an increased oil pressure, which requires a larger drive torque. Conversely, if the pressure in supply line 25 decreases, hydraulic pump 24 requires a smaller drive torque.

By decreasing or increasing the flow cross section of shut-off element 32 the flow resistance is changed and as a result the pressure in supply line 25 between shut-off element 32 and outlet 26 of hydraulic pump 24 changes. The drive torque necessary to drive hydraulic pump 24 is dependent on this pressure so that the drive torque can be influenced by controlling the cross section of shut-off element 32.

Closing shut-off element 32 leads to an increased oil pressure in supply line 25, as a result of which a larger drive torque becomes necessary. Conversely, opening shut-off element 32 leads to a lower pressure in supply line 25 so that a smaller drive torque is necessary. An electronically controlled valve 33 that preferably can be controlled in an infinitely variable fashion may be used as a shut-off element 32, as a result of which the accuracy in controlling the stopping position of the crankshaft 23 can be increased.

Figure 7:
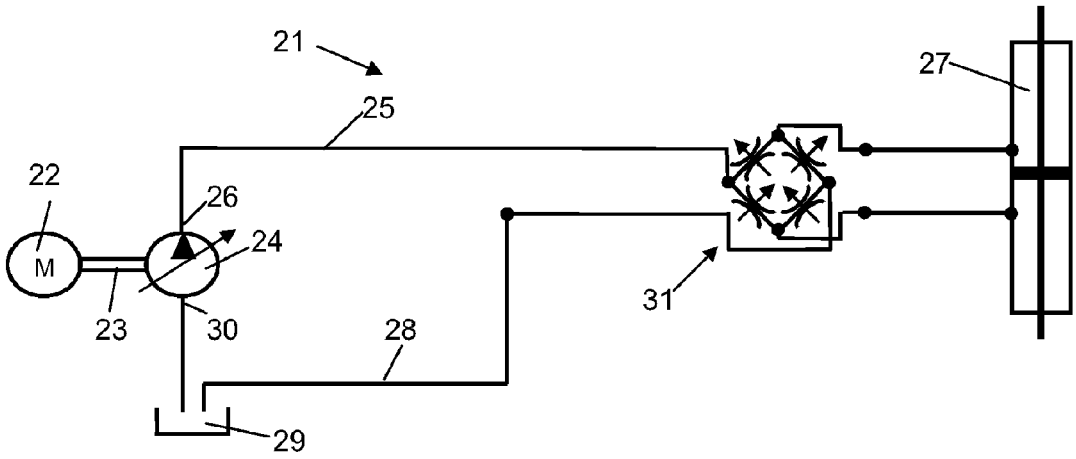
FIG. 7 is a schematic view of a seventh embodiment of an internal combustion engine according to the present invention.

FIG. 7 is a schematic view of a second embodiment of a power steering system 21 for use in controlled engine shutdown according to the present invention. Power steering system 21 shown in FIG. 7 does not have a shut-off element 32 in supply line 25, but instead uses a hydraulic pump 24 with a variable feed characteristic or throughput so that the drive torque can be varied without a shut-off element 32. A variable throughput can be implemented by means of a variable swept volume or a variable outlet opening 26, for example. Hydraulic pumps with a variable stroke volume, such as an adjustable axial piston pump may be used to provide a variable feed characteristic or a variable throughput. A variable adjustable outlet 26, i.e. an outlet 26 with a variable outlet opening, permits the outlet cross section to be adjusted and thus the throughput of the hydraulic pump 24 to be influenced directly. A variable outlet opening 26 also changes the flow resistance and permits the pressure at outlet 26 of hydraulic pump 24 to be changed to influence the drive torque of hydraulic pump 24. If the throughput of hydraulic pump 24 is increased, pump 24 requires an increased drive torque. Conversely, the necessary drive power can be decreased by reducing the throughput.

Of course, power steering system 21 may include both a shut-off element 32 in supply line 25 and a variable throughput hydraulic pump 24 to influence the drive torque of hydraulic pump 24. Use of both elements increases the flexibility and accuracy during the controlled shutting down of the internal combustion engine 22.

By using the hydraulic pump of the power steering system, a component of the internal combustion engine which is already present is used to bring about controlled shutting down. As such, it is not necessary to provide additional adjustment devices. In particular, it is not necessary to provide an active adjustment device such as an electric motor to rotate the crankshaft into the desired position after the internal combustion engine has been switched off. In this context, the hydraulic pump can be referred to as a passive adjustment device which exerts a torque on the crankshaft until the crankshaft comes to a standstill, preferably in the desired preferred position. In comparison with an active adjustment device, a passive adjustment device provides the advantage that its energy consumption is lower since it does not initiate a rotational movement of the crankshaft but rather merely suitably decelerates an existing rotational movement of the crankshaft.

Controlling stopping position of the crankshaft according to the present invention Such a method makes it possible to provide direct start, i.e. to start directly from the stationary state by injecting fuel into the combustion chambers of the stationary internal combustion engine and igniting by means of a spark plug. Of course, the present invention is also advantageous for engines having conventional starter motors in that the crankshaft and camshaft positions are known from commencement of the starting process so that a synchronization period is not required.

While the best mode for carrying out the invention has been described in detail, those familiar with the art to which this invention relates will recognize various alternative designs and embodiments for practicing the invention as defined by the following claims.

What is claimed is:

1. A method for controlling stopping position of a crankshaft in a multiple cylinder internal combustion engine having a crankshaft-driven fluid pump, the method comprising:

changing pressure of the fluid to change drive torque of the fluid pump during engine shutdown so the crankshaft stops in a position favorable for restarting.

2. The method of claim 1 wherein the internal combustion engine includes a power steering system and wherein the crankshaft-driven pump includes a power steering pump.

3. The method of claim 1 wherein the step of changing pressure comprises controlling a variable throughput fluid pump.

4. The method of claim 3 wherein the variable throughput fluid pump comprises a power steering pump.

5. The method of claim 3 wherein the variable throughput fluid pump comprises a fuel pump.

6. The method of claim 1 wherein the step of changing pressure comprises controlling a shut-off valve.

7. The method of claim 1 wherein the fluid pump includes a variable throughput fluid pump and wherein the step of changing pressure comprises controlling a shut-off valve in combination with the variable throughput pump.

8. The method of claim 1 wherein the step of changing pressure comprises:

determining kinetic energy of the engine at shutdown; and changing pressure based on the kinetic energy of the engine to control the stopping position of the crankshaft.

9. A method for controlled shutdown of an internal combustion engine equipped with a hydraulic power steering system having a hydraulic pump driven by the internal combustion engine to supply pressurized hydraulic fluid to the power steering system via a supply line connected to an outlet of the hydraulic pump, the method comprising:

influencing drive torque of the hydraulic pump such that energy of the internal combustion engine after ignition and/or fuel is switched off is consumed by the drive torque in a controlled fashion to stop the crankshaft in a predetermined position.

10. The method of claim 9 wherein the step of influencing comprises changing pressure within the supply line to influence drive torque of the hydraulic pump.

11. The method of claim 10 wherein the supply line includes a shut-off valve and wherein influencing drive torque comprises controlling the shut-off valve to change pressure within the supply line.

12. The method of claim 9 wherein the hydraulic pump has a controllable variable throughput and wherein the step of influencing comprises controlling the hydraulic pump throughput.

13. The method of claim 12 wherein the hydraulic pump has a variable stroke volume and wherein the step of influencing comprises controlling the stroke volume.

14. A system for controlling stopping position of a crankshaft during shutdown of an internal combustion engine, the system comprising:

a fluid pump driven by the crankshaft and supplying pressurized fluid to the engine;

a device for controlling pressure of the fluid during engine shutdown to vary drive torque of the fluid pump and control the stopping position of the crankshaft.

15. The system of claim 14 wherein the fluid pump comprises a power steering fluid pump.

16. The system of claim 14 wherein the fluid pump comprises a fuel pump.

17. The system of claim 14 wherein the device for controlling pressure of the fluid comprises a flow control valve.

18. The system of claim 14 wherein the device for controlling pressure comprises a variable throughput device integral to the fluid pump.

19. The system of claim 14 wherein the device for controlling pressure comprises a flow control valve and wherein the fluid pump comprises a variable throughput hydraulic pump.

20. The system of claim 14 wherein the device for controlling pressure comprises a flow control valve and wherein the fluid pump comprises a variable throughput fuel pump.

* * * * *